United States Patent [19]

Blore

[11] 4,229,954

[45] Oct. 28, 1980

[54] DOUBLE KNIT FABRIC

[75] Inventor: James H. Blore, Greenville, S.C.

[73] Assignee: Phillips Petroleum Company, Bartlesville, Okla.

[21] Appl. No.: 967,455

[22] Filed: Dec. 7, 1978

[51] Int. Cl.[2] ..... D04B 21/00

[52] U.S. Cl. ..... 66/196

[58] Field of Search ..... 66/196, 197, 198

[56] References Cited

U.S. PATENT DOCUMENTS

| | | | |
|---|---|---|---|
| 951,033 | 3/1910 | Steber | 66/196 |
| 1,722,391 | 7/1929 | Pfrommer | 66/196 |
| 2,127,139 | 8/1938 | Reynolds | 66/197 |
| 2,166,166 | 7/1939 | Larkin | 66/170 |
| 2,169,801 | 8/1939 | Jarvis | 66/197 |
| 3,609,999 | 10/1971 | Blore | 66/196 |
| 3,626,714 | 12/1971 | Blore | 66/196 |
| 3,808,843 | 5/1974 | Blore et al. | 66/196 |
| 3,937,041 | 2/1976 | Balcombe | 66/197 |
| 4,079,602 | 3/1978 | Blore | 66/196 |

OTHER PUBLICATIONS

Knitting Times, "How to Stop Snagging of Textured Polyester Double Knit Fabrics," Aug. 8, 1971 (Reprint).

*Primary Examiner*—Ronald Feldbaum

[57] ABSTRACT

A double knit fabric having at least a first set of alternating wales comprising a first wale and a second wale, said first set of alternating wales forming the face side of the fabric;

at least a second set of alternating wales comprising a first wale and a second wale, said second set of alternating wales forming the reverse side of the fabric; and at least six feed yarns, wherein the first wale of said first set of alternating wales has knit stitches produced by the first, third and fifth feed yarns, wherein the second wale of said first set of alternating wales has knit stitches produced by the second, fourth, and sixth feed yarns, wherein the first wale of the second set of alternating wales has knit stitches produced by the fourth feed yarn, and wherein the second wale of the second set of alternating wales has knit stitches produced by the first feed yarn.

5 Claims, 3 Drawing Figures

DOUBLE KNIT FABRIC

The invention relates to a double knit fabric. In one aspect, the invention is directed to a double knit fabric which is snag resistant.

Picks, pulls, or snags that appear in garments such as men's suits and pants, women's dresses, suits, and slacks, and upholstery made from textured polyester and nylon double knits have been a great deterrent to even more widespread use of these fabrics. In spite of the comfort, easy wash and wear properties, crease resistance, and low shrinkage of these fabrics a customer is apt to shy away from purchasing a garment made with such fabrics because of their tendency to snag.

Unfortunately the most wanted fabrics, particularly for men's garments and upholstery, are fabrics that have a textured surface. These textured surfaces are usually made by relief or blister stitches, where the dial needles or the needles that knit the back of the fabric on a double knit machine cease to operate for one or two feeds or one or two courses while the cylinder needles or the needles that knit the face of the fabric continue knitting. It is the cylinder needles that produce the blister. In essence, the cylinder needles produce a plain jersey fabric superimposed on the dial needle stitches. Plain jersey fabrics snag readily—particularly when knitted in a loose stitch from filament yarns such as stretch nylon or textured set polyester or nylon, stuffer-box crimped yarns, and knit-de-knit yarns made from nylon, polyester, or polypropylene.

A good example of this snagging propensity is the popular Ponti-di-Roma stitch that knits on a four feed repeat where the first feed knits alternate needles on the cylinder and dial, the second feed knits the remaining needles that did not knit on the first feed, the third feed knits all the cylinder needles but no dial needles and the fourth feed knits all dial needles, but no cylinder needles. The third course gives the trouble in snagging because this is, in essence, a plain jersey course. Many women's stockings are knitted in a plain jersey stitch to give maximum stretch and recovery and women's stockings are renowned for their snagging. In a plain jersey stitch, all needles knit at every course. When a snag occurs, the yarn is one loop is pulled from the fabric. As force is exerted on the yarn pulling from the fabric, it pulls yarn from the loops in the adjacent stitches. These loops grow smaller and pull yarn from their neighboring stitches until the first pulled loop may be an inch or longer in length or several dozen times longer than it normally should be.

Yarns that have an uneven or rough surface such as spun yarns made from a myriad of tiny fibers, have protruding fiber tips that resist the sliding of the loops through the stitches but fabrics made from these yarns do not have the appearance and other pleasing properties of fabrics made from textured polyester and nylon yarns.

Tight stitches tend to resist snagging. However when the cams are adjusted to draw tighter stitches, the weight of the fabric is increased because the courses per inch are increased, and the greater the number of courses per inch in the fabric, the greater is the fabric weight per linear yard and per square yard. This not only adds to the cost of the fabric because more yarn is used per linear yard, but the knitting machine produces less fabric in a given time. For instance, an 18 cut double knit machine knitting fabric at 60 courses per inch produces half as much fabric in an hour as a machine knitting fabric at 30 courses per inch. In addition, the fabric weight becomes too heavy to be used for such garments as men's pants or women's dresses.

There are stitches that resist snagging such as a $1 \times 1$ cord where the first course knits all cylinder needle stitches, but odd dial needles knit while even dial needles miss. The second course knits odd cylinder needles and misses even needles. The dial needles stitches are knit on odd needles and the even dial needles miss. The third course knits all cylinder needle stitches and the dial needles knit on even needles and miss on odd needles. The fourth course knits odd cylinder needles stitches and misses even needle stitches while the dial needles knit on even needles and miss on odd needles. This technique helps to lock the stitches in the fabric on back and face but because all or part of the dial needles and cylinder needles are operating at all feeds, the fabric is flat and there is no relief or blister to give a textured surface.

An object of the present invention is a double knit fabric which is snag resistant. Another object of the invention is double knit fabric in which the stitches produced by the cylinder needles are locked in place so that they do not readily pull out from their neighboring stitches and yet the double knit fabric has a textured appearance.

In accordance with the present invention, a double knit fabric has been discovered which is snag resistant and has a pleasing textured appearance.

Figure 1:
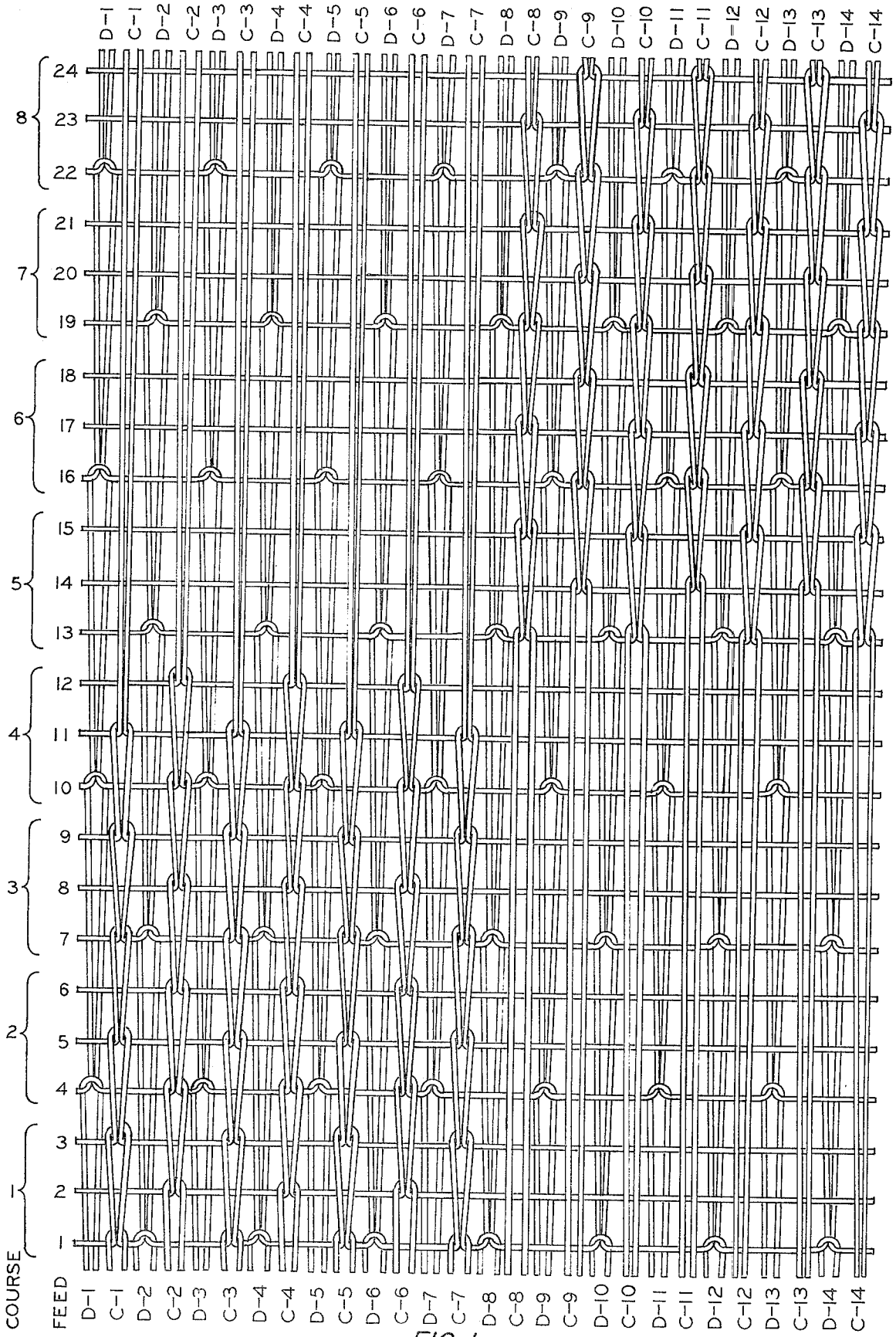
FIG. 1 is a schematic representation of one embodiment of the stitch construction for a double knit fabric in accordance with the invention, will the stitches being expanded to show both the face side stitches and the reverse side stitches.
Figure 2:
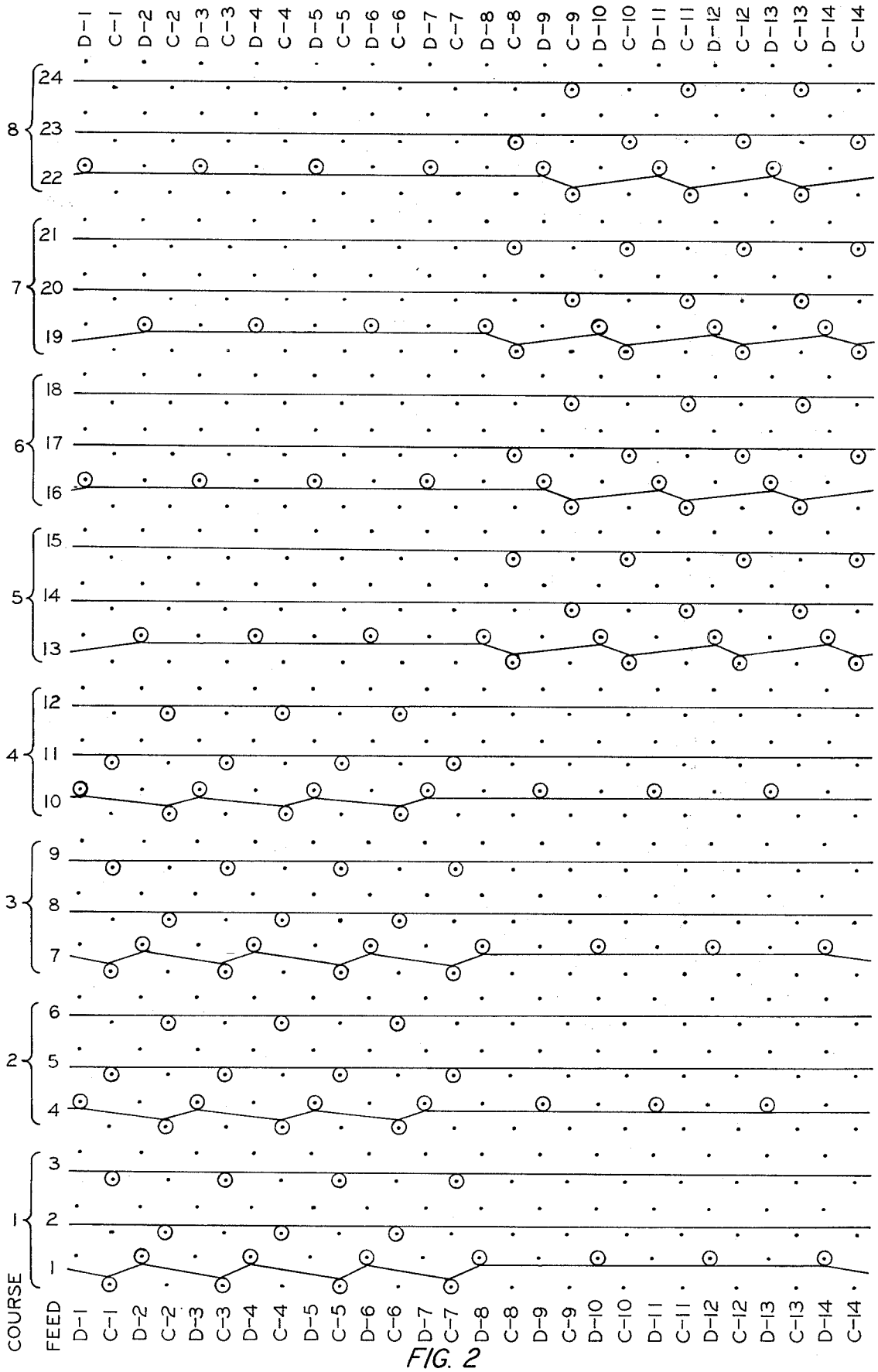
FIG. 2 is a pattern diagram of the face side stitches of the fabric illustrated in FIG. 1 formed by the cylinder needles of a circular knitting machine.
Figure 3:
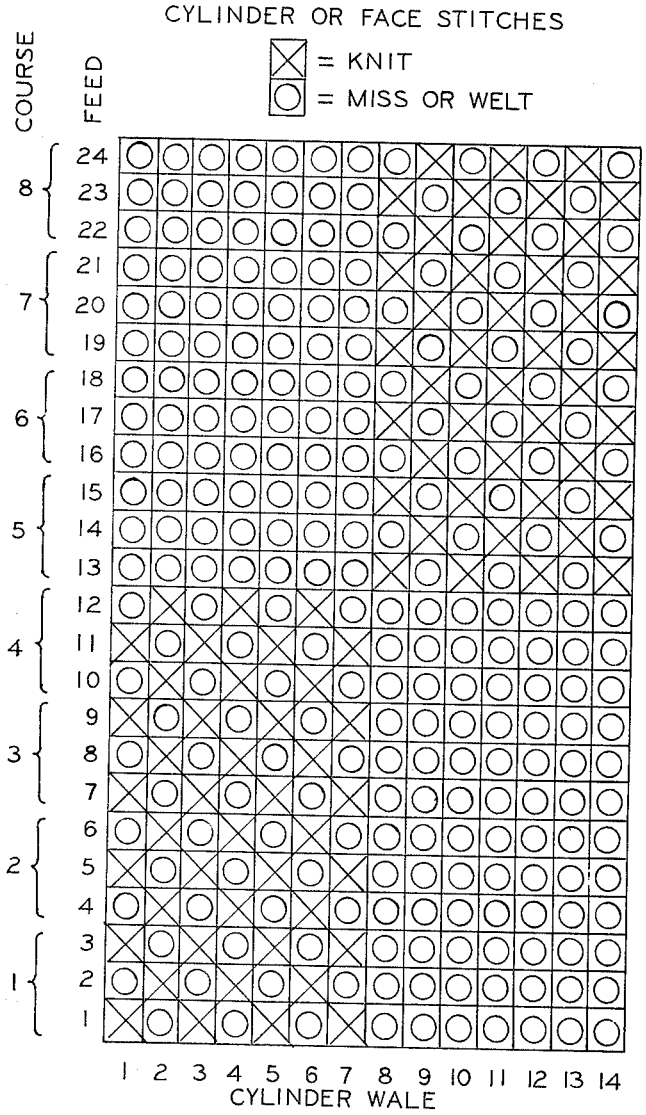
FIG. 3 is a pattern diagram of the face side stitches formed by the cylinder needles and the reverse side stitches formed by the dial needles in making the fabric shown in FIG. 1 on a circular knitting machine.

Referring now to the drawings, there is illustrated a fabric swatch 28 wales wide and 8 courses high, wherein each course has 3 feeds. The 28 wales are produced by 14 cylinder needles and 14 dial needles. The cylinder needles are designated by the prefix "C" and the dial needles are designated by the prefix "D". The swatch of fabric shown in the drawings is representative of a basket stitch double knit fabric employing the present invention. It is important to note that the present invention broadly can be used for a basket stitch double knit fabric as shown in the drawings or for most any double knit fabric employing such stitches as the twill stitch, the vertical stripe stitch, the herringbone stitch, etc.

The drawings illustrate the double knit fabric of the present invention having at least 4 wales and at least 6 feeds. The first feed knits only wales on cylinder needle C-1 and on dial needle D-2, feeds 2 and 6 knit only the wale on cylinder needle C-2, feeds 3 and 5 knit only the wale on cylinder needle C-1, and feed 4 knits only wales on dial needle D-1 and on cylinder needle C-2. This description represents the repeating pattern which is used to produce the double knit fabric in accordance with the present invention, and as shown in the drawings, this repeating pattern is illustrated for courses 1, 2, 3, and 4 for a total of the first 14 wales and in courses 5, 6, 7, and 8 for the second 14 wales.

The total swatch of fabric shown in the drawings employs the snag resistant configuration of the present invention for a basket stitch double knit fabric. As shown in the drawings, courses 1, 2, 3, and 4 in the second group of 14 wales only knit certain dial needles and no cylinder needles, and courses 5, 6, 7, and 8 only knit certain dial needles of the first group of 14 wales and no cylinder needles.

The swatch of fabric shown in the drawings which represent a basket stitch double knit fabric having 8 courses wherein each course has 3 feeds and 28 wales which are knitted on 14 cylinder needles and 14 dial needles is described as follows. Feeds 1 and 7 knit only wales on cylinder needles C-1, C-3, C-5 and C-7 and on dial needles D-2, D-4, D-6, D-8, D-10, D-12 and D-14. Feeds, 2, 6, 8 and 12 knit only wales on cylinder needles C-2, C-4 and C-6. Feeds 3, 5, 9 and 11 knit only wales on cylinder needles C-1, C-3, C-5 and C-7. Feeds 4 and 10 knit only wales on cylinder needles C-2, C-4 and C-6, and on dial needles D-1, D-3, D-5, D-7, D-9, D-11, and D-13. Feeds 13 and 19 knit only wales on cylinder needles C-8, C-10, C-12 and C-14, and on dial needles D-2, D-4, D-6, D-8, D-10, D-12 and D-14. Feeds 14, 18, 20, and 24 knit only wales on cylinder needles C-9, C-11 and C-13. Feeds 15, 17, 21 and 23 knit only wales on cylinder needles C-8, C-10, C-12 and C-14 and feeds 16 and 22 knit only wales on cylinder needles C-9, C-11, and C-13, and on dial needles D-1, D-3, D-5, D-7, D-9, D-11 and D-13.

While the yarns employed to produced the snag resistant double knit fabrics of the present invention can be selected from a wide range of yarns generally employed to produce double knit fabrics, such yarns are generally selected from textured nylon, polyester and polypropylene yarns. Also the yarns employed can be different colors so that a multicolor fabric is produced, but generally the yarns employed are essentially one color or tone.

It is further understood that the above description and drawings are not intended to unduly limit the scope of the invention since a variety of modifications and changes would be obvious to one skilled in the art without deviating from the proper scope and intent of the invention.

What is claimed is:

1. A double knit fabric comprising a first set of consecutive courses, a second set of consecutive courses, a first set of consecutive wales having a first set of alternating wales and a second set of alternating wales with each interior wale of said first set of alternating wales being positioned between two wales of the second set of alternating wales, and a second set of consecutive wales having a first set of alternating wales and a second set of alternating wales with each interior wale of said first set of alternating wales being positioned between two wales of said second set of alternating wales, wherein the first set of alternating wales of the first and second sets of consecutive wales form the face side of said fabric and the second set of alternating wales of the first and second sets of consecutive wales form the reverse side of said fabric;

said fabric having a repeat pattern of at least one first set of consecutive courses followed by at least one second set of consecutive courses and a first set of consecutive wales followed by a second set of consecutive wales, each said first and second sets of alternating wales of said first set of consecutive wales containing at least two wales and each said first and second sets of alternating wales of said second set of consecutive wales containing at least two wales;

each said first set of consecutive courses comprising consecutively first, second, third, fourth, fifth and sixth courses;

the first course of each said first set of consecutive courses having knit stitches in the first wale of the first set of alternating wales of the first set of consecutive wales and in the second wale of the second set of alternating wales of the first set of consecutive wales, welt stitches in the first wale of the second set of alternating wales of the first set of consecutive wales and in the second wale of the first set of alternating wales of the first set of consecutive wales, knit stitches in the first wale of the second set of alternating wales of the second set of consecutive wales, and welt stitches in the first and second wales of the first set of alternating wales of the second set of consecutive wales and in the second wale of the second set of alternating wales of the second set of consecutive wales;

the second course and the sixth course of each said first set of consecutive courses having knit stitches in the second wale of the first set of alternating wales of the first set of consecutive wales, welt stitches in the first and second wales of the second set of alternating wales of the first set of consecutive wales and in the first wale of the first set of alternating wales of the first set of consecutive wales, and welt stitches in the first and second wales of each of the first set of alternating wales and the second set of alternating wales of the second set of consecutive wales;

the third and fifth courses of each of said first set of consecutive courses having knit stitches in the first wale of the first set of alternating wales of the first set of consecutive wales, welt stitches in the second wale of the first set of alternating wales of the first set of consecutive wales and in the first and second wales of the second set of alternating wales of the first set of consecutive wales, and welt stitches in the first and second wales of each of the first set of alternating wales and the second set of alternating wales of the second set of consecutive wales;

the fourth course of the first set of consecutive courses having knit stitches in the second wale of the first set of alternating wales of the first set of consecutive wales and in the first wale of the second set of alternating wales of the first set of consecutive wales, knit stitches in the second wale of the second set of alternating wales of the second set of consecutive wales, and welt stitches in the first and second wales of the first set of alternating wales of the second set of consecutive wales and in the first wale of the second set of alternating wales of the second set of consecutive wales;

each said second set of consecutive courses comprising consecutively first, second, third, fourth, fifth and sixth courses;

the first course of each of said second set of consecutive courses having knit stitches in the second wale of the second set of alternating wales of the first set of consecutive wales, welt stitches in the first and second wales of the first set of alternating wales of the first set of consecutive wales and in the first wale of the second set of alternating wales of the first set of consecutive wales, knit stitches in the first wale of the first set of alternating wales of the second set of consecutive wales and in the first wale of the second set of alternating wales of the second set of consecutive wales, and welt stitches in the second wale of the first set of alternating wales of the second set of consecutive wales and in the second wale of the second set of alternating wales of the second set of consecutive wales;

the second course and the sixth course of each of said second set of consecutive courses having welt stitches in the first and second wales of each of the first and second sets of alternating wales of the first set of consecutive wales, knit stitches in the second wale of the second set of alternating wales of the second set of consecutive wales, and welt stitches in the first and second wales of the second set of alternating wales of the second set of consecutive wales and in the first wale of the first set of alternating wales of the second set of consecutive wales;

the third course and the fifth course of each of said second set of consecutive courses having welt stitches in the first and second wales of each of the first and second sets of alternating wales of the first set of consecutive wales, knit stitches in the first wale of the first set of alternating wales of the second set of consecutive wales, and welt stitches in the second wale of the first set of alternating wales of the second set of consecutive wales and in the first and second wales of the second set of alternating wales of the second set of consecutive wales; and the fourth course of each of said second sets of consecutive courses having knit stitches in the first wale of the second set of alternating wales of the first set of consecutive wales, welt stitches in the first and second wales of the first set of alternating wales of the first set of consecutive wales and in the second wale of the second set of alternating wales of the first set of consecutive wales, knit stitches in the second wale of the first set of alternating wales of the second set of consecutive wales and in the second wale of the second set of alternating wales of the second set of consecutive wales, and welt stitches in the first wale of the first set of alternating wales of the second set of consecutive wales and in the first wale of the second set of alternating wales of the second set of consecutive wales.

2. A double knit fabric according to claim 1 produced with yarns which are essentially the same color.

3. A double knit fabric according to claim 1 produced with a yarn selected from the group consisting of textured nylon, polyester and polypropylene yarns.

4. A double knit fabric in accordance with claim 1 comprising at least two consecutive first sets of consecutive courses followed by at least two second sets of consecutive courses.

5. A double knit fabric in accordance with claim 4 wherein the first and second sets of alternating wales of the first set of consecutive wales and the first and second sets of alternating wales of the second set of consecutive wales each comprise seven wales.

* * * * *